US009505585B2

(12) United States Patent
Haapaniemi et al.

(10) Patent No.: US 9,505,585 B2
(45) Date of Patent: Nov. 29, 2016

(54) METHOD FOR MODERNIZING A HYDRAULIC ELEVATOR

(71) Applicant: KONE CORPORATION, Helsinki (FI)

(72) Inventors: Markku Haapaniemi, Helsinki (FI); Tapani Talonen, Tervakoski (FI)

(73) Assignee: KONE CORPORATION, Helsinki (FI)

( * ) Notice: Subject to any disclaimer, the term of this patent is extended or adjusted under 35 U.S.C. 154(b) by 428 days.

(21) Appl. No.: 13/917,013

(22) Filed: Jun. 13, 2013

(65) Prior Publication Data

US 2013/0333982 A1 Dec. 19, 2013

(30) Foreign Application Priority Data

Jun. 14, 2012 (FI) ..... 20125657

(51) Int. Cl.

| | |
|---|---|
| ***B66B 1/24*** | (2006.01) |
| ***B66B 5/00*** | (2006.01) |
| ***B66B 5/02*** | (2006.01) |
| ***B66B 9/04*** | (2006.01) |
| *B66B 19/00* | (2006.01) |

(52) U.S. Cl.

CPC ..... *B66B 1/24* (2013.01); *B66B 5/0031* (2013.01); *B66B 5/028* (2013.01); *B66B 9/04* (2013.01); *B66B 19/007* (2013.01)

(58) Field of Classification Search

CPC ..... B66B 1/24; B66B 5/031; B66B 5/028; B66B 9/04

USPC ..... 187/275

See application file for complete search history.

(56) References Cited

U.S. PATENT DOCUMENTS

| | | | | | |
|---|---|---|---|---|---|
| 454,872 | A * | 6/1891 | Krell | B66B 9/04 | 187/272 |
| 2,647,590 | A * | 8/1953 | Anderson, Jr. | B66B 1/04 | 187/285 |
| 3,650,356 | A * | 3/1972 | Brown | B66B 9/04 | 187/274 |
| 4,066,148 | A * | 1/1978 | Brown | B66B 9/04 | 187/275 |
| 4,534,452 | A * | 8/1985 | Ogasawara | B66B 1/24 | 187/285 |
| 4,762,203 | A * | 8/1988 | Ryan | B66B 9/04 | 187/223 |
| 4,787,481 | A | 11/1988 | Farrar et al. | | |
| 4,962,832 | A * | 10/1990 | Maney | B66F 7/04 | 187/209 |

(Continued)

FOREIGN PATENT DOCUMENTS

| | | |
|---|---|---|
| FR | 2 782 505 A1 | 2/2000 |
| JP | 5-12465 A | 1/1993 |

(Continued)

*Primary Examiner* — Michael Riegelman

(74) *Attorney, Agent, or Firm* — Birch, Stewart, Kolasch & Birch, LLP

(57) ABSTRACT

A method for modernizing a hydraulic elevator including an elevator car guided by car guide rails for moving in an essentially vertical direction in the elevator hoistway, a hydraulic system including a lifting cylinder having a cylinder part essentially vertically supported on the base of the elevator hoistway and a piston rod moving in relation to the cylinder part and a hydraulic powerpack and a control center. The hydraulic system of the hydraulic elevator is modernized to include a function for preventing unintended starting at a floor, in such a way that the hydraulic powerpack is retained and an electrically-operating valve that is monitored with a control and that acts on the flow of hydraulic fluid of the lifting cylinder is added to the hydraulic system. The control controls a valve to prevent movement of the piston rod of the lifting cylinder downwards and/or upwards, if predetermined criteria are fulfilled.

14 Claims, 2 Drawing Sheets

(56) References Cited

U.S. PATENT DOCUMENTS 4,976,338 A * 12/1990 Holland ..... B66B 1/24 187/285
7,665,579 B2 * 2/2010 Itose ..... B66F 9/22 137/490
2004/0074702 A1 * 4/2004 Moser ..... B66B 9/04 187/275
2005/0241883 A1 * 11/2005 Zuzuly ..... B66B 1/405 187/277

FOREIGN PATENT DOCUMENTS

JP 2009-102149 A 5/2009
WO WO 98/42610 A1 10/1998

* cited by examiner

Prior Art
Fig. 1
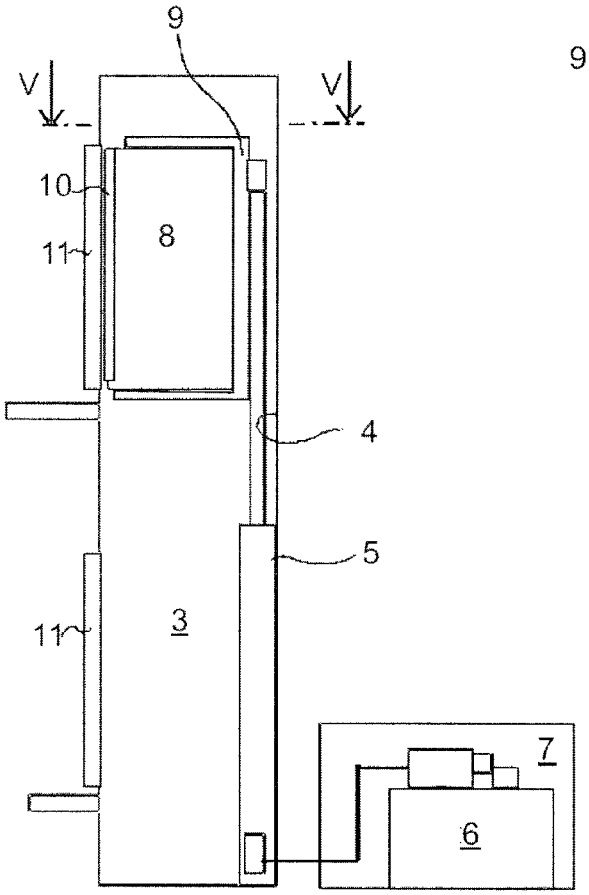
Prior Art
Fig. 2
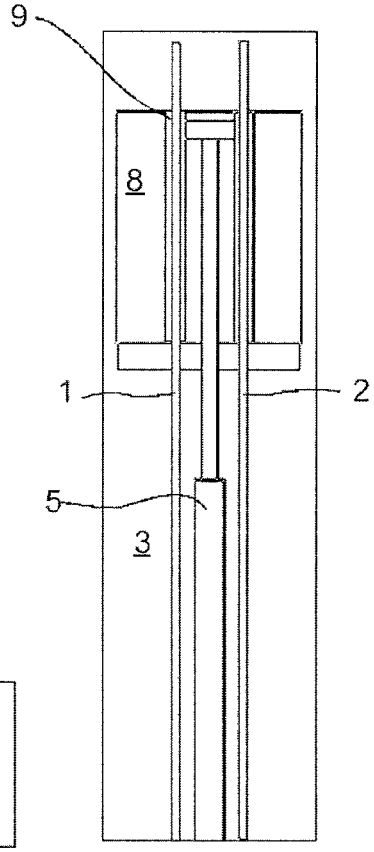
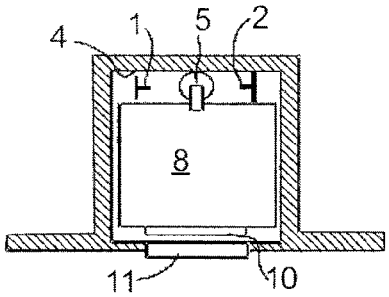
Fig. 3
Prior Art
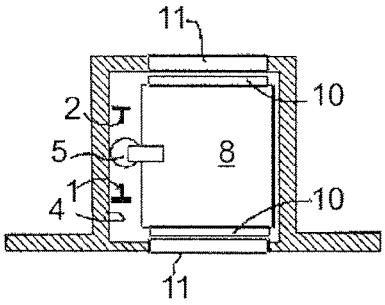
Fig. 4
Prior Art

METHOD FOR MODERNIZING A HYDRAULIC ELEVATOR

FIELD OF THE INVENTION

The object of the invention is a method for modernizing a hydraulic elevator.

BACKGROUND OF THE INVENTION

In hydraulic elevators, as also in other elevator systems, it is important to endeavor to maximize the safety of passengers. The elevator car may not drop freely nor may its movement reach uncontrolled acceleration of movement and the uncontrolled deceleration of movement following it. Sudden stops with even comparatively small kinetic energy can cause injury of passengers.

New elevator safety regulations require the monitoring and prevention of unintended starting of elevators. In hydraulic elevators prevention of this unintended starting can be arranged in different ways than in rope elevators because hydraulic elevators do not generally have a counterweight or compensating weight, but instead all the force needed for moving the elevator car is transmitted from the hydraulic powerpack of the elevator, along either a hose or pipe to the lifting cylinder of the elevator.

Known in the art is a hydraulic elevator, which is in an elevator hoistway that is in a building. A hydraulic elevator comprises vertical car guide rails, with which the elevator car is guided to move in the elevator hoistway in an essentially vertical direction. The lifting cylinder can be in a space between the wall of the elevator hoistway and the elevator car, or the lifting cylinder can be disposed in a space directly below the elevator car.

A hydraulic elevator can be a so-called rucksack-type elevator that is rear-lifting, wherein the car guide rails are on the same side as the lifting cylinder behind the rear wall of the car, or a side-lifting elevator, wherein the car guide rails and the lifting cylinder are on a side that is beside the side wall, in which case it is possible to achieve a so-called walk-through car, in which the car doors are on opposite walls of the car. The rear wall of the car refers to the opposite wall in relation to the car door and the side wall refers to a wall of the elevator car that is beside the car door.

The lifting cylinder comprises a cylinder part supported essentially vertically on a fixed structure of the elevator hoistway, and a piston rod moving in relation to the cylinder part, which piston rod is arranged in functional connection with the car for moving the car either fixed directly to the car sling of the car or indirectly via a rope. In an indirect drive hydraulic elevator there is a rope diverting pulley at the end of the piston rod, over which pulley a rope is led, which rope is fixed at one of its ends to a fixed structure in the bottom end of the elevator hoistway and at the other end is fixed to the car sling. For producing hydraulic pressure for driving the lifting cylinder, the hydraulic elevator further comprises a hydraulic powerpack, which is usually disposed in a machine room, which is a room separate to the elevator hoistway beside, or in the proximity of, the bottom end of the elevator hoistway.

Hydraulic elevators are very common. Usually they are modernized in such a way that the elevator is kept as a hydraulically driven one, and the hydraulic powerpack and necessary components are replaced with new corresponding ones. A problem in these prior-art modernization methods of a hydraulic elevator is the high costs and slow installation. If it is desired to retrofit to a hydraulic elevator a function for preventing unintended starting, it can be done by replacing the entire hydraulic powerpack with one that is provided with a function for preventing unintended starting. This is, however, slow and expensive in terms of costs, and causes interruption of the operation of the elevator for a long time and causes considerable inconvenience to users at the installation site.

With this invention the aforementioned problems are eliminated. With the method according to the invention the modernizing of a hydraulic elevator to be according to safety regulations can be done quickly and cost-effectively. According to the method a function preventing unintended starting is added to an old hydraulic system by adding to it an electrically-operating valve that is monitored with control means and that acts on the flow of hydraulic fluid of the lifting cylinder. In this way an old hydraulic elevator can be made to be according to new safety regulations inexpensively and reliably and use of the elevator does not need to be interrupted for a long time.

GENERAL DESCRIPTION OF THE INVENTION

The aim of the present invention is to solve the aforementioned problems of prior-art solutions as well as the problems disclosed in the description of the invention below. The aim is to produce a reliable and inexpensive method for modernizing a hydraulic elevator to be according to new safety regulations, more particularly by adding to the old hydraulic elevator a function preventing unintended starting in such a way that the existing components and structures of an old hydraulic elevator can be saved and utilized as much as possible.

With the method according to the invention a hydraulic elevator is modernized to be according to new safety regulations by adding to the old hydraulic elevator a function preventing unintended starting in such a way that the old hydraulic powerpack is retained and an electrically-operating valve that is monitored with control means and that acts on the flow of hydraulic fluid of the lifting cylinder is installed in old the hydraulic system.

According to one embodiment of the invention the hydraulic powerpack comprises a valve stack and a main shut-off valve and a valve for preventing unintended starting is installed after the valve stack of the hydraulic powerpack before the main shut-off valve, in which case the electrical connections caused by the valve are easy to make.

According to a second embodiment of the invention the hydraulic system comprises a rupture valve in connection with the lifting cylinder and a valve for preventing unintended starting is installed immediately in connection with the lifting cylinder integrated into the rupture valve or beside it. This device simultaneously functions as a rupture valve and as a device for preventing unintended starting, in which case there are as many valves as there are cylinders. At the same time electrical monitoring is installed, because these valves must be electrically monitored so that the jamming of some valve does not enable the operation of other lifting cylinders, in which case damaging of structures is a danger.

According to a third embodiment of the invention the hydraulic system comprises a pressure relief valve or inward relief valve and a valve for preventing unintended starting is installed in the pressure relief valve or inward relief valve, in which case the elevator is not able to start moving in dangerous situations.

With the method according to the invention, a supervision unit of the electrically-operating valve is installed in the control center of a hydraulic elevator modernized to be according to safety regulations for preventing unintended starting. The control systems of hydraulic elevators typically comprise a control part of the elevator, comprising a traffic controller, to which calls coming from the floors are directed, and a drive part controlling the hydraulic powerpack, which on the other hand typically comprises a movement controller, a speed regulator, a hydraulic pump regulator and also a safety circuit. Received in the drive control as feedback data are the position of the elevator car for controlling movement, speed for speed adjustment, current for adjusting the electric motor of the hydraulic pump, and control data relating to safety from the safety contactors, with which the current from the pump drive can be disconnected when stopping at a floor. The control means of the electrical valve for preventing unintended starting preferably comprise a supervision unit, with which the operation of the added valve is supervised and controlled. In connection with a modernization according to the invention, a supervision unit is installed in the control center and the necessary electrical connections to it are made.

With the control means the operation of the valve acting on the flow of hydraulic fluid of the lifting cylinder is monitored and the control means control the valve to prevent movement of the piston rod of the lifting cylinder downwards and/or upwards, if predetermined criteria are fulfilled. The predetermined criteria preferably comprise the status of the car doors and/or landing doors of the elevator car, more particularly the opening/closing of the aforementioned doors. The predetermined criteria can also comprise some status connected to operation of the elevator, preferably a status connected to servicing of the elevator and to servicing procedures.

The electronic supervision must operate in both directions, for example if a control contactor of the hydraulic motor fails, the valve for preventing unintended starting closes, because the control unit of the elevator has not given the elevator starting permission.

One advantage of the invention is that by utilizing the old components and hydraulic powerpack of a hydraulic elevator a modernized elevator that is according to new safety regulations, and is therefore safer than before, can be achieved.

Another advantage is the simple installation for modernizing a hydraulic elevator to be according to new safety regulations, the short installation time, few possibilities of installation error, and the elevator can be installed by one person.

In one embodiment of the method the first end of the hoistway is the bottom end, in which case the powerpack module is arranged in the proximity of the bottom end of the hoistway, and the second end of the hoistway is the top end. Alternatively, the first end of the hoistway is the top end, in which case the powerpack module is arranged in the proximity of the top end of the hoistway.

The elevator is most preferably an elevator applicable to the transporting of people and/or of freight, which elevator is installed in a building, to travel in a vertical direction, or at least in an essentially vertical direction, preferably on the basis of landing calls and/or car calls. The elevator comprises one or more elevator units and the elevator car preferably has an interior space, which is most preferably suited to receive a passenger or a number of passengers. The elevator preferably comprises at least two, preferably more, floor landings to be served.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described mainly in connection with its preferred embodiments, with reference to the attached drawings, wherein FIG. 1 diagrammatically presents a side view of a hydraulic elevator according to one embodiment, FIG. 2 diagrammatically presents a rear view of the hydraulic elevator according to the embodiment of FIG. 1, FIG. 3 diagrammatically presents a V-V cross-section of the hydraulic elevator according to FIG. 1, FIG. 4 correspondingly to FIG. 3 presents a diagrammatic cross-section of a hydraulic elevator according to a second embodiment, FIG. 5 diagrammatically presents an embodiment of a hydraulic powerpack modernized with the method according to the invention.

DETAILED DESCRIPTION OF THE INVENTION

Figure 5:
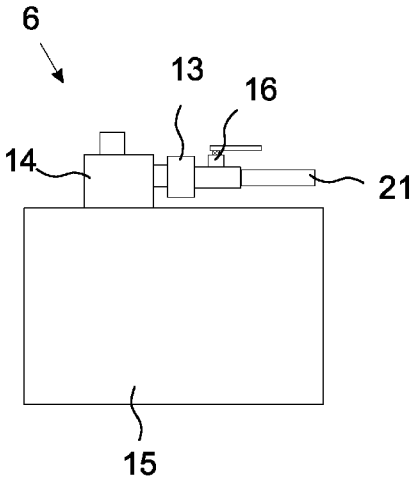

FIGS. 1-4 diagrammatically present some known hydraulic elevators according to some embodiments, which hydraulic elevators can be modernized with the method according to the invention to be according to safety regulations by adding a function preventing unintended starting to the old hydraulic powerpack or hydraulic system. FIGS. 1 and 2 diagrammatically present a rear-lifting rucksack-type elevator, wherein the car guide rails 1, 2 are on the same side as the lifting cylinder 5 behind the rear wall of the car 8. The building comprises an elevator hoistway 3. The elevator hoistway 3 is bounded downwards by the base and sideways by a wall 4. It is seen from FIG. 2 that there are essentially vertical car guide rails 1 and 2 in the elevator hoistway 3. The hydraulic elevator further comprises an elevator car 8, which comprises a car sling 9. The elevator car 8 is guided by the car guide rails 1, 2 for moving in an essentially vertical direction in the elevator hoistway 3. Both the car guide rails 1 and 2 are disposed in the proximity of the wall 4 of the elevator hoistway 3 on the same side in relation to the elevator car 8. The lifting cylinder 5 is arranged in the space between the wall 4 of the elevator hoistway 3 and the elevator car 8. The lifting cylinder 5, 12 comprises a cylinder part 5 essentially vertically supported on the base of the elevator hoistway and a piston rod 12 moving in relation to the cylinder part 5, which piston rod is directly attached to the car sling 9 of the elevator car 8 for moving the elevator car. Consequently, the hydraulic elevator is a so-called direct drive hydraulic elevator, in which the piston rod 12 is directly attached to the car sling 9 of the elevator car 8. In a hydraulic elevator the hydraulic powerpack 6, which produces the hydraulic pressure needed for the lifting cylinder 5, 12 and which controls the functions of the elevator, is in a machine room 7 separate from the elevator hoistway 3, which is a room separate to the elevator hoistway beside, or in the proximity of, the bottom end of the elevator hoistway. Additional mass can also be attached to the elevator car 8, which mass ensures the downward movement of the empty unloaded elevator car.

FIG. 3 presents a diagrammatic V-V cross-section of the hydraulic elevator according to FIG. 1, wherein the car guide rails 1, 2 and the lifting cylinder 5, 12 are in a space between the rear wall of the elevator car, said wall being opposite in relation to the car door 10 of the elevator car 8, and the rear wall of the elevator hoistway 3.

FIG. 4 presents correspondingly to FIG. 3 a diagrammatic cross-section of a hydraulic elevator, wherein the car guide rails 1, 2 and also the lifting cylinder 5, 12 are in a space between the side wall of the elevator car, said wall being beside in relation to the car door 10 of the elevator car 8, and the side wall of the elevator hoistway 3. According to the embodiment of FIG. 4, a side-lifting elevator has been achieved, wherein the car guide rails 1, 2 and the lifting cylinder 5, 12 are on a side that is beside the side wall 4, in which case a so-called walk-through car, in which the car doors 10 and/or the landing doors 11 are on opposite walls of the car 8, has been achieved. The rear wall of the car 8 refers to the opposite wall in relation to the car door 10 and the side wall refers to a wall of the elevator car 8 beside the car door 10.

Figure 6:
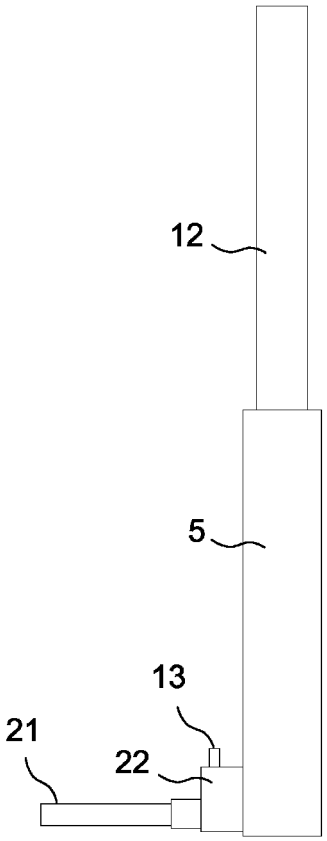
FIG. 6 diagrammatically presents an embodiment of a second hydraulic system modernized with the method according to the invention.

The prior art hydraulic elevator of FIGS. 1-4 can be modernized to be according to safety regulations with the method according to the invention by adding a function preventing unintended starting to the old hydraulic system, as presented in FIGS. 5 and 6. The function preventing unintended starting is intended for use in an elevator for detecting and stopping unintended movement of the elevator car 8 when the valve 13 intended to keep the car 8 of the elevator in its position has tripped. There is no brake at all in a hydraulic elevator and in directly lifted elevators there is no overspeed governor or safety gear, because the elevator car 8 is rigidly connected to the piston rod 12 of the lifting cylinder 5, 12.

FIG. 5 diagrammatically presents an embodiment of a hydraulic powerpack 6 modernized with the method according to the invention. With the method according to the invention a hydraulic elevator is modernized to be according to new safety regulations by adding to the old hydraulic elevator a function preventing unintended starting in such a way that the old hydraulic powerpack 6 is retained and an electrically-operating, monitored valve 13, preferably a shut-off valve, is installed in the old powerpack 6, in which case in the closed position the valve closes the flow channel in respect of the flow traveling in at least one of the directions, possibly also in both directions. Preferably the aforementioned at least one direction is the direction preventing downward movement of the elevator car. The valve can be solenoid operated, i.e. the drive device of the valve comprises a solenoid. According to one embodiment of the invention the aforementioned valve 13 is added either after the valve stack 14 of the hydraulic powerpack before the main shut-off valve 16. The hydraulic system comprises a valve stack 14 of the hydraulic powerpack 6 for controlling the flow of hydraulic fluid into the lifting cylinder 5, 12 or out of the cylinder as well as a main shut-off valve 16 between the valve stack 14 and the lifting cylinder 5, 12. It is advantageous to place the valve preventing unintended starting here between, because then the electrical connections caused by the valve 13 are easy to make.

FIG. 6 diagrammatically presents a second embodiment of a hydraulic system modernized with the method according to the invention. According to the second embodiment of the invention, a valve 13 for preventing unintended starting is installed immediately in connection with the lifting cylinder 5, 12 integrated into the rupture valve 22 or beside it. In this case the device simultaneously functions as a rupture valve and as a device preventing unintended starting, in which case there are as many valves as there are cylinders. At the same time electrical monitoring is installed, because these valves must be electrically monitored so that the jamming of some valve does not enable the operation of other lifting cylinders, in which case damaging of structures is a danger.

According to a third embodiment of the invention a valve 13 for preventing unintended starting is installed in the pressure relief valve or in the inward relief valve, in which case the elevator is not able to start moving in dangerous situations.

The function preventing unintended starting comprises a flow sensor to be connected to a valve 13, with which a movement detector can be implemented. When the elevator does not have permission to start and the sensor detects a flow through the valve, the supervision circuit trips the valve 13 for preventing unintended starting, in which case the elevator stops. If it is desired to enhance the operation of the device, an electric coil is also added to the lifting cylinder, or in the case of a number of lifting cylinders into the rupture valve 22 separately fixed to each cylinder, in which case also the rupture valve 22 can close, in which case stopping of the elevator is ensured.

In addition, the function preventing unintended starting comprises, in addition to the valve 13, control means in a form of a supervision unit 20 for determining the permitted movement of the car and for controlling the valve 13 to trip according to the detections of the sensor.

Figure 7:
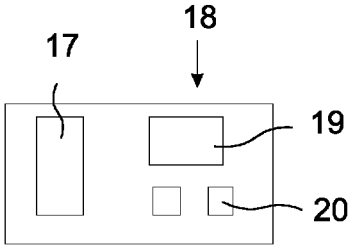
FIG. 7 diagrammatically presents an embodiment of a control unit of a hydraulic elevator modernized with the method according to the invention.

FIG. 7 diagrammatically presents a control center 18 of a hydraulic elevator modernized with the method according to the invention to be according to safety regulations. The control center 18 of hydraulic elevators typically comprises a control part 17 of the elevator and also a drive part 19 controlling the hydraulic powerpack. The control part 17 of the elevator comprises a traffic controller, to which calls coming from the floors are directed. The drive part 19, on the other hand, typically comprises a movement controller, a speed regulator, a hydraulic pump regulator and also a safety circuit. Received in the drive control as feedback data are the position of the elevator car for controlling movement, speed for speed adjustment, current for adjusting the electric motor of the hydraulic pump, and control data relating to safety from the safety contactors, with which the current from the pump drive can be disconnected when stopping at a floor. The control means of the electrical valve 13 comprise a supervision unit 20, with which the operation of the valve 13 is supervised and controlled. A supervision unit 20 is installed in connection with modernization in the control center 18 and the necessary electrical connections to it are made.

Monitoring of the valve 13 also works the other way round. If the rupture valve 22 trips, information about that goes to the supervision unit 20, which closes the valve disposed next to this valve block. The system only lets out the amount of oil that had time to flow before the rupture valve 22 operated and what is in the hoses and pipes between the hoisting machine and the cylinder when the pipe ruptured. In normal cases this amount of oil comprises approx. 20-30 liters of oil. In the worst case when driving the elevator upwards and after a pipe has broken all the oil volume in the tank might have time to be pumped out, in which case approx. 100 liters of additional oil volume is involved. Thus by installing a valve 13 the occurrence of a reasonably large oil accident can also be prevented.

The electronic supervision must operate in both directions, for example if a control contactor of the hydraulic motor fails, the valve 13 for preventing unintended starting closes, because the control unit of the elevator has not given the elevator starting permission.

In connection with modernization the old car 8 and/or car sling 9 and/or car doors 10 and/or landing doors 11 of the hydraulic elevator can be kept.

Alternatively any whatsoever of these can be replaced with new ones. The hydraulic powerpack 6 and the other apparatus to be connected to the elevator can be stored in the machine room 7.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

It is obvious to the person skilled in the art that in developing the technology the basic concept of the invention can be implemented in many different ways. The invention and the embodiments of it are not limited to the examples described above, but instead they may be varied within the scope of the claims.

The invention claimed is:

1. A method for modernizing a hydraulic elevator, which hydraulic elevator comprises an elevator car, which elevator car is guided by car guide rails for moving in an elevator hoistway; and a hydraulic system, which comprises:

a lifting cylinder, which is arranged in a space between a wall of the elevator hoistway and the elevator car, which lifting cylinder comprises a cylinder part supported on a base of the elevator hoistway, and a piston rod movable in relation to the cylinder part, which piston rod is arranged to move the elevator car along the car guide rails, and a hydraulic powerpack, which produces an hydraulic pressure needed for the lifting cylinder, a control center, which comprises control means for controlling the movement of the elevator car, and in which method the hydraulic system of the hydraulic elevator is modernized to comprise a function for preventing unintended starting at a floor, wherein an electrically-operating valve that is monitored with a control and that acts on a flow of hydraulic fluid of the lifting cylinder is added to the hydraulic system, and the control controls the valve to prevent movement of the piston rod of the lifting cylinder downwards and/or upwards, if predetermined criteria are fulfilled, wherein the hydraulic powerpack comprises:

a valve stack; and a main shut-off valve, and wherein the valve is located between the valve stack of the hydraulic powerpack and the main shut-off valve.

2. The method according to claim 1, wherein the predetermined criteria comprise a status of the car doors and/or landing doors of the elevator car.

3. The method according to claim 2, wherein the control is arranged to control a transfer in the aforementioned manner into a state preventing movement of the piston rod in connection with a stopping of the elevator car at a floor.

4. The method according to claim 3, wherein the control controls the valve to prevent movement of the piston rod of the lifting cylinder downwards and/or upwards until the car doors and/or landing doors of the elevator car have closed.

5. The method according to claim 4, wherein the control is added to the hydraulic system, with which control the valve acting on the flow of hydraulic fluid of the lifting cylinder is monitored.

6. The method according to claim 5, wherein the hydraulic system comprises a rupture valve, and the valve is added integrated into the rupture valve or beside the rupture valve.

7. The method according to claim 2, wherein the hydraulic system comprises a rupture valve, and the valve is added integrated into the rupture valve or beside the rupture valve.

8. The method according to claim 3, wherein the hydraulic system comprises a rupture valve, and the valve is added integrated into the rupture valve or beside the rupture valve.

9. The method according to claim 4, wherein the hydraulic system comprises a rupture valve, and the valve is added integrated into the rupture valve or beside the rupture valve.

10. The method according to claim 1, wherein the hydraulic system comprises a rupture valve, and the valve is added integrated into the rupture valve or beside the rupture valve.

11. The method according to claim 1, wherein the control for the valve is added to the control, said control comprising an electrical supervision unit functioning in opening and closing the valve.

12. The method according to claim 1, wherein the control center of the hydraulic elevator comprises a control part, a drive part and a control, which comprises a supervision unit for the one or more valves.

13. The method according to claim 1, wherein the hydraulic system comprises a rupture valve, and an electric coil is added to the lifting cylinder, or in the case of a number of lifting cylinders into the rupture valve separately fixed to each cylinder, in which case also the rupture valve can close, in which case stopping of the elevator is ensured.

14. The method according to claim 1, wherein the car of the hydraulic elevator, the car doors and/or the landing doors, the hydraulic powerpack, other apparatuses connected to the elevator, and the control center, are not replaced.

* * * * *